US008960515B2

(12) United States Patent
Dabamoto

(10) Patent No.: US 8,960,515 B2
(45) Date of Patent: Feb. 24, 2015

(54) WEB GUIDING APPARATUS

(75) Inventor: Sadao Dabamoto, Touon (JP)

(73) Assignees: Justin Co., Ltd., Shikokuchuo-shi, Ehime (JP); Wintec Co., Ltd., Touon-shi, Ehime (JP)

( * ) Notice: Subject to any disclaimer, the term of this patent is extended or adjusted under 35 U.S.C. 154(b) by 204 days.

(21) Appl. No.: 13/640,384

(22) PCT Filed: Nov. 15, 2010

(86) PCT No.: PCT/JP2010/006691
§ 371 (c)(1),
(2), (4) Date: Dec. 14, 2012

(87) PCT Pub. No.: WO2011/132244
PCT Pub. Date: Oct. 27, 2011

(65) Prior Publication Data

US 2013/0075441 A1 Mar. 28, 2013

(30) Foreign Application Priority Data

Apr. 23, 2010 (JP) ..... 2010-099406

(51) Int. Cl.
*B65H 23/038* (2006.01)

(52) U.S. Cl.
CPC .... *B65H 23/038* (2013.01); *B65H 2404/14212* (2013.01); *B65H 2404/15212* (2013.01); *B65H 2301/531* (2013.01); *B65H 2511/12* (2013.01); *B65H 2402/46* (2013.01)
USPC ..... 226/21

(58) Field of Classification Search
CPC ..... B65H 23/038; B65H 2402/46; B65H 2301/531; B65H 2511/12; B65H 2404/15212; B65H 2404/14212
USPC ..... 226/3, 15, 18–20, 21–23; 242/615.1
See application file for complete search history.

(56) References Cited

U.S. PATENT DOCUMENTS 3,682,362 A * 8/1972 Ott, Jr. ..... 226/21
4,204,619 A * 5/1980 Damour ..... 226/21
4,342,412 A * 8/1982 Lorenz et al. ..... 226/21

(Continued)

FOREIGN PATENT DOCUMENTS

JP 2000128408 A * 5/2000

*Primary Examiner* — William E Dondero
(74) *Attorney, Agent, or Firm* — Weaver Austin Villeneuve & Sampson LLP

(57) ABSTRACT

Provided is a web guiding apparatus capable of ensuring a smooth operation and durability against a force applied from a web even if the apparatus is used in an environment with airborne paper powder, dust and the like.

The web guiding apparatus includes a rocking frame 4 rocking around an axis perpendicular to a reference surface 2*s* of the base 2, and a support portion 40 supporting movement of the rocking frame 4 with respect to the base 2. The support portion 40 includes a base member 41 provided on the base 2 and having a rolling surface parallel to the reference surface 2*s* of the base 2, and a roller 46 provided on the rocking frame 4 so as to roll on the rolling surface of the base member 41. The rolling surface of the base member 41 is formed so that an axial direction thereof intersects an arc with a rocking shaft 3 of the rocking frame 4 as a center. A width of the roller 46 is wider than a width of the rolling surface of the base member 41. The roller 46 is provided so as to move along the arc with the rocking shaft 3 of the rocking frame 4 as the center when the rocking frame 4 rocks.

2 Claims, 6 Drawing Sheets

(56) References Cited

U.S. PATENT DOCUMENTS 5,387,962 A * 2/1995 Castelli et al. ..... 399/165
6,474,528 B2 * 11/2002 Scharschinger et al. ..... 226/180
7,296,717 B2 * 11/2007 Swanson et al. ..... 226/3
2001/0040178 A1 * 11/2001 Scharschinger et al. ..... 226/180
2005/0002718 A1 * 1/2005 Winter et al. ..... 400/579
2005/0109811 A1 * 5/2005 Swanson et al. ..... 226/3
2005/0158106 A1 * 7/2005 Winter et al. ..... 400/619

* cited by examiner

WEB GUIDING APPARATUS

TECHNICAL FIELD

The present invention relates to a web guiding apparatus. In a production line or a required processing line for a belt-shaped material (hereinafter, referred to as a web) made of paper, a nonwoven fabric, a film, a steel plate, or the like, a web may meander during running due to imbalance between rollers, misalignment of a reel, or the like. Such web meandering causes reduction in a production speed, production of defectives, or the like. A web guiding apparatus is therefore used for properly correcting such web meandering during running.

The present invention relates to a web guiding apparatus for properly correcting such web meandering during running.

BACKGROUND ART

A web guiding apparatus including a rocking frame provided with a pair of rollers having a web wound around with which web meandering is prevented by causing the rocking frame to rock has been developed (Patent Literature 1).

Patent Literature 1 discloses a web guiding apparatus 100 including a movable table 104 (corresponding to the rocking frame) having a pair of rollers 105,105, as illustrated in FIG. 6(A). The web guiding apparatus 100 includes the movable table 104 rockably provided on both sides thereof (a vertical direction in FIG. 6) by a rocking shaft 103. Guide balls 112 supported by holders 111 are provided at a tip of the movable table 104 (a position away from the rocking shaft 103).

Such a configuration allows the guide balls 112 to support the tip of the movable table 104 when the movable table 104 rocks. This therefore allows the movable table 104 to smoothly rock, thereby being able to prevent web meandering.

Patent Literature 1 also discloses a web guiding apparatus 200 in which movement of a movable table 204 including a pair of rollers 205,205 is supported by link mechanisms 210, as illustrated in FIG. 6(B). The link mechanism 210 includes a pair of shafts 211,212 provided on the movable table 204 and a base 202, and a link member 213 rotatably coupled to the pair of shafts 211,212 and bendably provided between the pair of shafts 211,212.

The web guiding apparatus 200 also allows the link mechanism 210 to support the tip of the movable table 204 when the movable table 204 rocks. This therefore allows the movable table 204 to smoothly rock.

In the case of using the web guiding apparatus 100 in a place such as a paper mill where paper powder, dust, and the like fly in all directions, the paper power and the like may get stuck between the holder 111 and the guide ball 112, causing space therebetween to be blocked with the paper powder. This may prevent the guide ball 112 from smoothly moving or, in the worst case, the guide ball 112 may not move at all. The movable table 104 cannot therefore rock, leading to failure in preventing meandering of a web W.

On the other hand, the web guiding apparatus 200 has higher durability against the paper power and the like compared with the web guiding apparatus 100 having the guide ball 112 held by the holder 111. This is because the pair of shafts 211,212 is coupled to the link member 213 by a bearing or the like.

In the web guiding apparatus 200, a force is applied from a web wound around the pair of rollers 205,205 in an axial direction of the pair of shafts 211,212. As for the force, the web guiding apparatus 200 is, however, inferior to the web guiding apparatus 100 in FIG. 6(A) in durability.

As described above, existing web guiding apparatuses realize both durability against paper powder and the like and durability against a force applied from a web in some extent, however, a web guiding apparatus realizing both of the durability at a higher level has been required.

CITATION LIST

Patent Literature

Patent Literature 1: Japanese Patent Laid-Open No. 2000-128408

SUMMARY OF INVENTION

Technical Problem

In view of the above circumstances, an object of the present invention is to provide a web guiding apparatus capable of ensuring a smooth operation and durability against a force applied from a web even if the apparatus is used in an environment with airborne paper powder, dust and the like.

Solution to Problem

A web guiding apparatus according to a first feature of the present invention is an apparatus for preventing meandering of a web conveyed successively, comprising: a base; a rocking frame rocking around an axis perpendicular to a reference surface of the base; a roller for web provided on the rocking frame and having a rotation axis parallel to the reference surface of the base, the web being wound around the roller; and a support portion provided between the rocking frame and the base, and supporting movement of the rocking frame with respect to the base, wherein the support portion comprises: a base member provided on the base and having a rolling surface parallel to the reference surface of the base; and a roller provided on the rocking frame so as to roll on the rolling surface of the base member, the rolling surface of the base member is formed so that an axial direction thereof intersects an arc with a rocking shaft of the rocking frame as a center, a width of the roller is wider than a width of the rolling surface of the base member, and the roller is provided so as to move along the arc with the rocking shaft of the rocking frame as the center when the rocking frame rocks.

A web guiding apparatus according to a second feature of the present invention is the first feature of the present invention, wherein the base member comprises: a housing hole of a long hole extending along a direction parallel to the reference surface of the base, the roller being provided in the housing hole, a pair of the rolling surfaces is formed on a pair of inner surfaces, in the housing hole, extending along an axial direction thereof and opposed with each other, and the roller is provided in the housing hole.

Advantageous Effects of Invention

According to the first feature of the present invention, the rocking frame rocks around the axis perpendicular to the reference surface of the base. This allows the web to return to a predetermined position even if an end of the web in a width direction thereof slips out of position. Moreover, since the roller provided on the rocking frame is provided so as to roll on the rolling surface parallel to the reference surface, the rocking frame can stably rock. Durability against a force applied from the web can also be enhanced because the force applied from the web is supported by surface contact of the roller with the rolling surface. Further, since the roller rolls so as to intersect an axial direction of the rolling surface, the roller can remove paper powder and the like from the rolling surface even if the paper powder and the like is accumulated on the rolling surface. Accordingly, even if the apparatus is used in an environment with airborne paper powder and the like, failure in rocking of the rocking frame or the like is hard to occur due to the paper powder and the like. This enables to enhance durability against the paper powder and the like.

According to the second feature of the present invention, the roller can come into contact with the rolling surface even if the apparatus is provided in any direction, enabling to enhance a degree of freedom in a layout or the like of equipment to which the apparatus is provided.

DESCRIPTION OF EMBODIMENT

An embodiment of the present invention will now be described with reference to the drawings.

A web guiding apparatus of the present invention is provided in a conveyance path for conveying a web or the like obtained by forming paper, a nonwoven fabric, a film, a steel plate, or the like into a belt-like shape (hereinafter, simply referred to as a web). The web guiding apparatus is used for preventing a phenomenon in which the web moves in a width direction thereof, that is, occurrence of meandering.

Also, according to the web guiding apparatus of the present invention, a smooth operation can be maintained for a long period of time even if the apparatus is used in an environment with airborne paper powder, dust and the like.

(Brief Description of Web Guiding Apparatus 1)

A web guiding apparatus 1 of the embodiment will be first described briefly.

Figure 1:
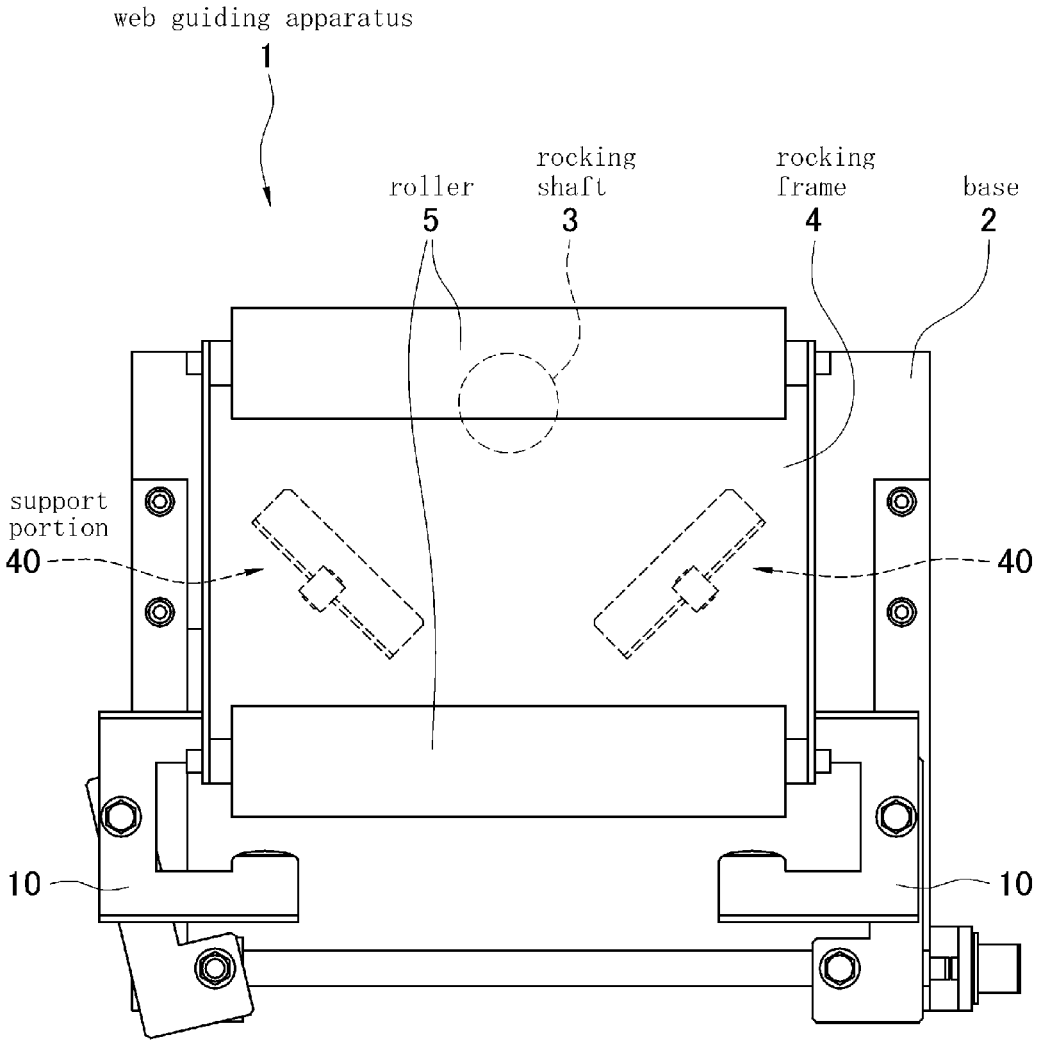
FIG. 1 is a schematic plan view of a web guiding apparatus 1 of an embodiment.
Figure 2:
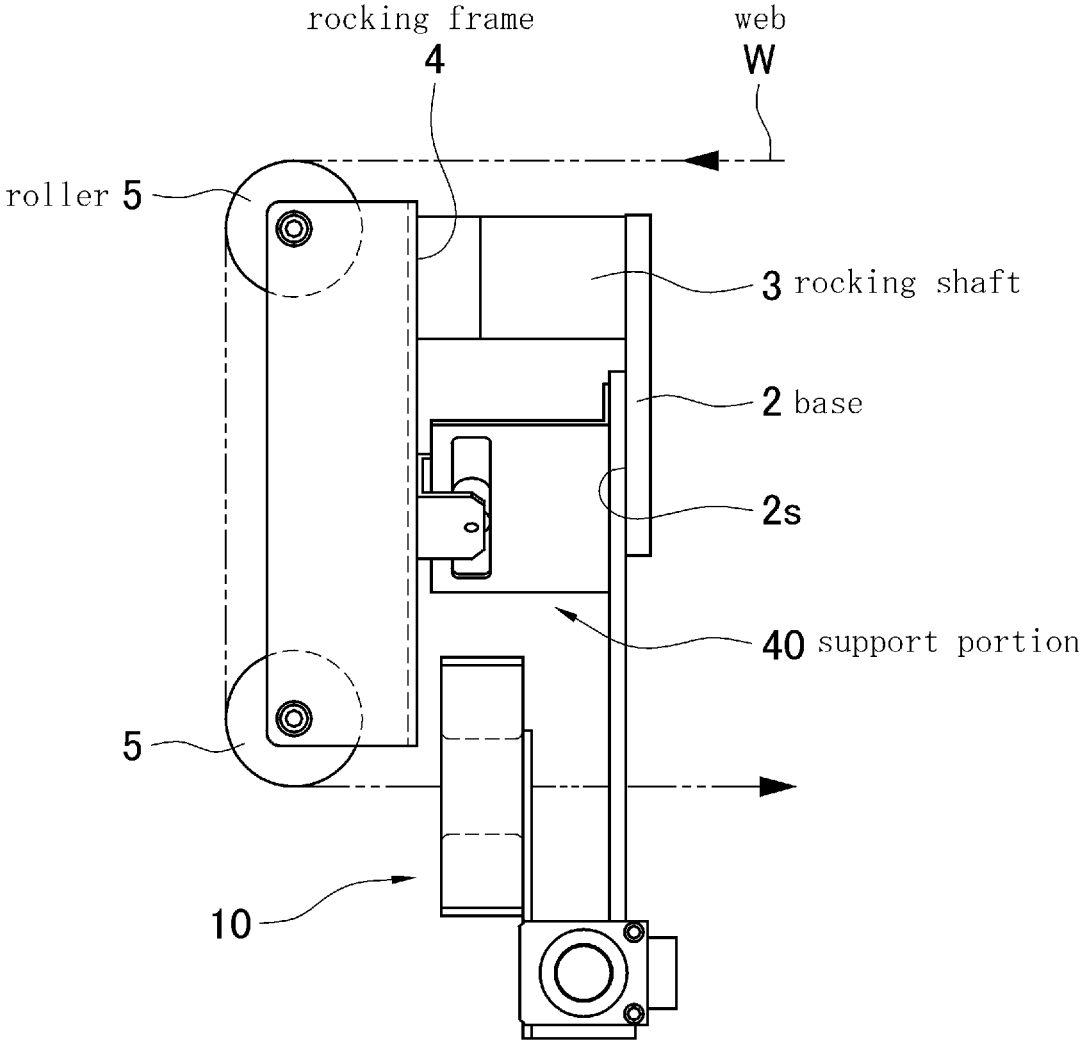
FIG. 2 is a schematic side view of the web guiding apparatus 1 of the embodiment.

In FIGS. 1 and 2, reference numeral 2 indicates a base of the web guiding apparatus 1 of the embodiment provided in a production line of a web, or the like. The web guiding apparatus 1 is provided in the production line or the like by fixing the base 2 to a frame or the like (not shown). For example, the web guiding apparatus 1 can be fixed to a frame or the like so that a top surface 2*s* of the base 2 becomes substantially horizontal.

A rocking frame 4 is provided above the base 2. One end of the rocking frame 4 (a top end in FIG. 1) is attached to a rocking shaft 3 standing on the top surface 2*s* of the base 2. The rocking shaft 3 is provided so that a central axis thereof is perpendicular to the top surface 2*s* of the base 2, while the rocking frame 4 is attached so as to be rockable around the central axis of the rocking shaft 3. That is, the rocking frame 4 is attached to the rocking shaft 3 so as to be rockable along a surface parallel to the top surface 2*s* of the base 2 (hereinafter, referred to as a reference surface 2*s* of the base 2).

As illustrated in FIGS. 1 and 2, the rocking frame 4 is provided with a pair of rollers 5,5 around which a web W is wound. The pair of rollers 5,5 is provided so that rotation axes thereof are parallel to each other and both of the rotation axes are parallel to the reference surface 2*s* of the base 2. In other words, a plane including the rotation axes of both the pair of rollers 5,5, exists, and the plane is parallel to the reference surface 2*s* of the base 2.

Moreover, the pair of rollers 5,5 is provided so that a midpoint in an axial direction thereof is located on a plane including the central axis of the rocking shaft 3 and perpendicular to the reference surface 2*s* of the base 2.

The other end of the rocking frame 4 (a lower end in FIG. 1) is also provided with a pair of support portions 40,40. The pair of support portions 40,40 supports the other end of the rocking frame 4 when the rocking frame 4 rocks around the central axis of the rocking shaft 3. Details thereof will be described later.

As illustrated in FIGS. 1 and 2, the web guiding apparatus 1 of the embodiment is provided with a position detection sensor 10 detecting an end of the web W, which is wound around the pair of rollers 5,5, in a width direction thereof. The position detection sensor 10 is connected to a control apparatus (not shown) where an operation of rocking means for rocking the rocking frame 4 is controlled based on a signal transmitted from the position detection sensor 10.

According to the web guiding apparatus 1 of the embodiment with the above configuration, when the web W moves in the width direction (a lateral direction in FIG. 1) during the conveyance, the position detection sensor 10 detects the movement of the end of the web W in the width direction, so that the control apparatus (not shown) operates the rocking means.

The operation of the rocking means causes the rocking frame 4 to rock with the rocking shaft 3 as a pivot, allowing the rotation axes of the pair of rollers 5,5 to rock in parallel with the reference surface 2*s* of the base 2. The rotation axes of the pair of rollers 5,5 can be inclined to a conveyance direction of the web W, and therefore, a force along the width direction of the web W can be generated between the web W and the pair of rollers 5,5.

As a result, the web W can be moved in the width direction along a direction of the rotation axes of the pair of rollers 5,5, that is, the web W can be returned to an original position because the web W can be moved in the width direction.

The above rocking means is not particularly limited as long as the rocking means allows the rocking frame 4 to rock. For example, a known mechanism can be employed in which the rocking frame 4 is rocked by operating a known driving apparatus such as a motor or a cylinder.

(Description of Support Portion 40)

As illustrated in FIG. 1, the web guiding apparatus 1 of the embodiment is provided with the pair of support portions 40,40. The pair of support portions 40,40 is provided to be symmetric with respect to the plane including the central axis of the rocking shaft 3 and perpendicular to the reference surface 2*s* of the base 2.

Although the pair of support portions 40,40 may not be provided at the above positions, rocking of the rocking frame 4 can be supported stably with the above configuration.

Additionally, the number of the support portions 40 is not necessarily two. One support portion 40, or three or more support portions 40 may be provided.

Figure 3:
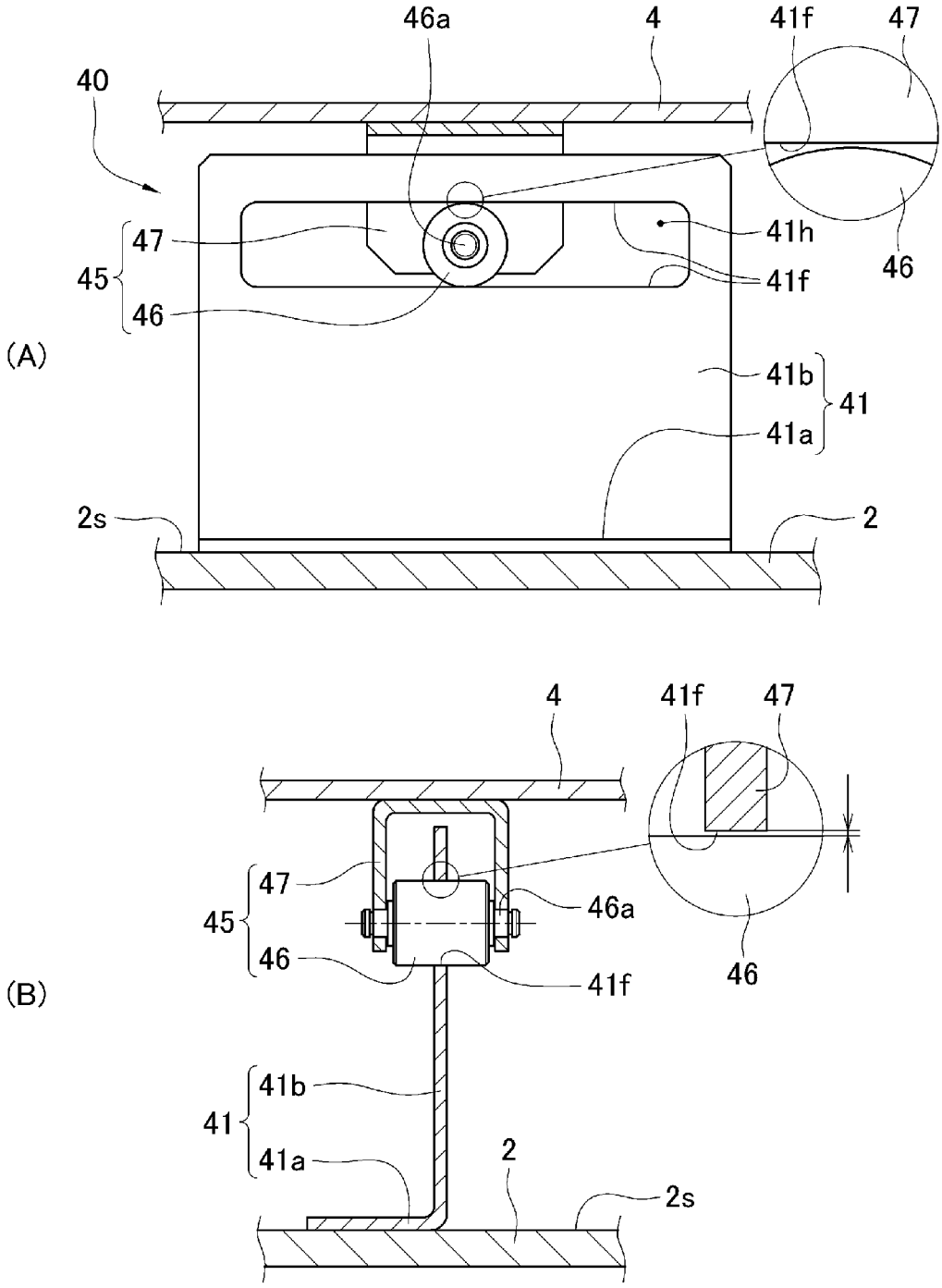
FIG. 3 shows enlarged views of a support portion 40.
Figure 4:
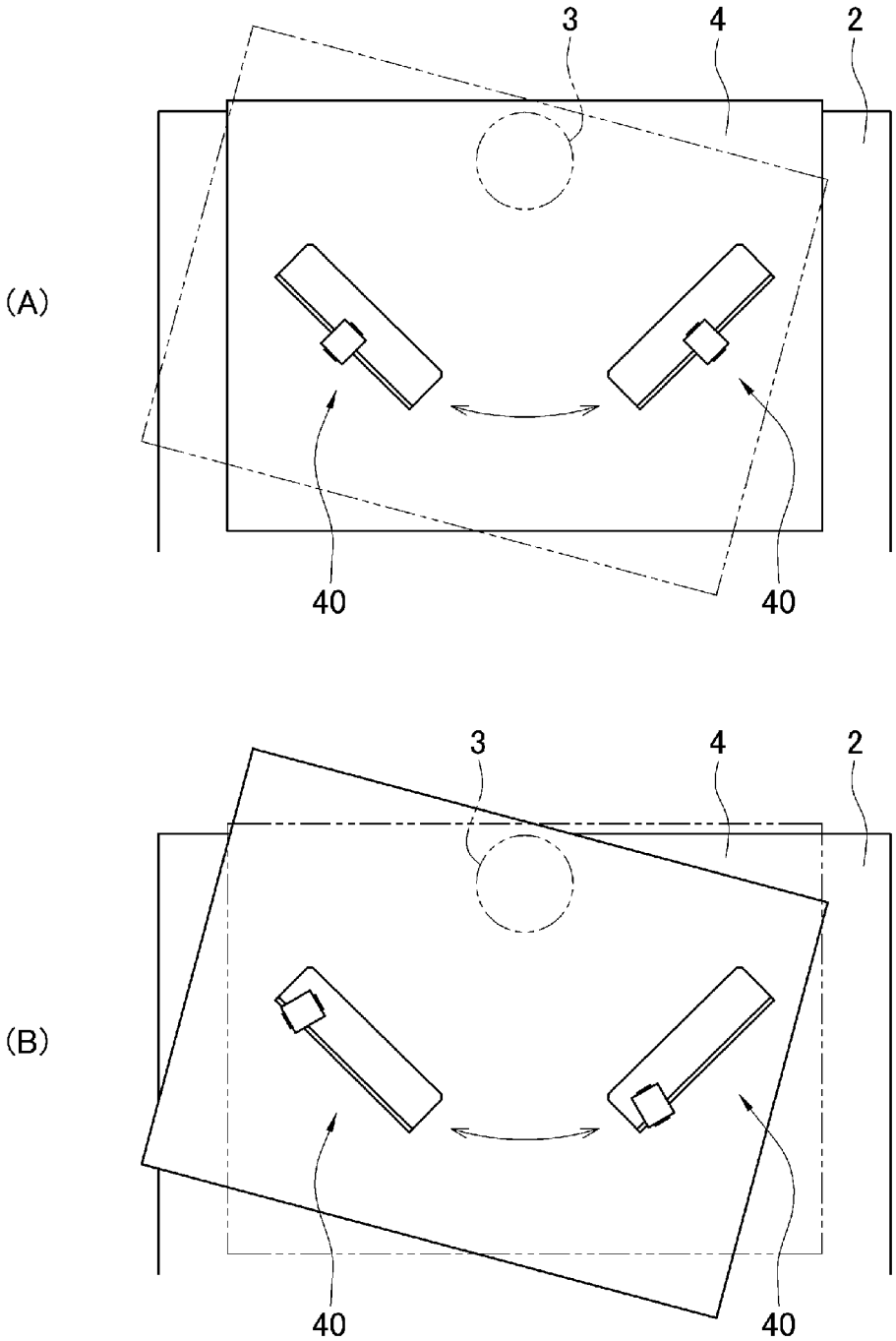
FIG. 4 shows schematic views illustrating a relationship between a rocking state of a rocking frame 4 and a state of the support portion 40.

As illustrated in FIG. 3, the support portion 40 includes a base member 41 provided on the reference surface 2*s* of the base 2, and a roller unit 45 attached to a surface of the rocking frame 4 opposed to the reference surface 2*s* of the base 2 (an under surface in FIG. 3, and hereinafter, simply referred to as an under surface).

(Description of Base Member 41)

As illustrated in FIG. 3, the base member 41 is formed by bending a plate-like member in an L shape. The base member 41 is attached with an under surface of an attachment part 41*a* of the base member 41 being in surface contact with the reference surface 2*s* of the base 2, and is provided so that a vertical part 41*b* of the base member 41 is perpendicular to the reference surface 2*s* of the base 2. That is, the base member 41 is attached to the reference surface 2*s* of the base 2 so that a normal direction of a surface of the vertical part 41*b* becomes parallel to the reference surface 2*s* of the base 2.

The base member 41 is also provided so that the normal direction of the surface of the vertical part 41*b* is perpendicular to a tangential direction of an arc with the central axis of the rocking shaft 3 as a center.

As illustrated in FIG. 3, the vertical part 41*b* of the base member 41 is provided with a housing hole 41*h*. The housing hole 41*h* is a through hole whose axial direction (a lateral direction in FIG. 3(A)) is parallel to the reference surface 2*s* of the base 2. Moreover, in the housing hole 41*h*, a pair of inner surfaces 41*f* (inner surfaces 41*f* arranged vertically in FIG. 3(A)) sandwiching a central axis of the housing hole 41*h* therebetween is formed into flat surfaces parallel to the reference surface 2*s* of the base 2. The pair of inner surfaces is further formed so that an axial direction thereof is parallel to the tangential direction of the arc with the rocking shaft 3 as the center. The reason will be described later.

Hereinafter, the pair of inner surfaces 41*f* in the housing hole 41*h* is referred to as a rolling surface 41*f*.

(Description of Roller unit 45)

As illustrated in FIG. 3, a roller 46 is provided in the housing hole 41*h* of the base member 41. The roller 46 is rotatably supported by a bracket 47 fixed to an under surface of the rocking frame 4.

The roller 46 is provided on the bracket 47 so that an extension of a rotation shaft 46*a* of the roller 46 intersects an extension of the rocking shaft 3. That is, the roller 46 is provided so that a central axis of the rotation shaft 46*a* is located on the plane including the rocking shaft 3 and perpendicular to the reference surface 2*s* of the base 2.

Additionally, a roller whose width (a length in a direction of the rotation axis) is larger than a plate thickness of the vertical part 41*b* of the base member 41, that is, a roller whose width is larger than that of the rolling surface 41*f* is used for the roller 46 (FIG. 3(B)).

According to the web guiding apparatus 1 of the embodiment with the above configuration, when the rocking frame 4 rocks, the roller 46 moves along the arc with the central axis of the rocking shaft 3 of the rocking frame 4 as the center while rolling on the rolling surface 41*f*. At this time, even if the rocking frame 4 rocks, the rotation axes of the pair of rollers 5,5 are maintained parallel to the reference surface 2*s* of the base 2. This is because the rolling surface 41*f* is parallel to the reference surface 2*s* of the base 2.

Since the web W is wound around the pair of rollers 5,5, a force pressing the rocking frame 4 toward the base 2 is applied to the rocking frame 4 via the pair of rollers 5,5. The force is supported by the rocking shaft 3 and the pair of support portions 40,40.

In the web guiding apparatus 1 of the embodiment, the above force is applied to the base member 41 from the roller 46 of the roller unit 45 of the rocking frame 4. At this time, the force is supported by bringing a surface of the roller 46 into surface contact with the rolling surface 41*f*, and therefore, durability of the support portion 40 against the force can be enhanced.

Further, when a web guiding apparatus is used in an environment with airborne paper powder and the like, the paper powder and the like may be accumulated on the rolling surface 41*f*. The accumulated paper powder and the like may prevent the roller 46 from rolling.

However, in the web guiding apparatus 1 of the embodiment, when the rocking frame 4 rocks, the roller 46 moves along the arc with the rocking shaft 3 of the rocking frame 4 as the center, whereas the rolling surface 41*f* is formed so that the axial direction thereof is parallel to the tangential direction of the arc with the rocking shaft 3 as the center.

The roller 46 therefore rolls so as to intersect the axial direction of the rolling surface 41*f*, allowing the roller 46 to remove the paper powder and the like from the rolling surface 41*f* even if the paper powder and the like is accumulated on the rolling surface 41*f*.

Accordingly, even if the apparatus is used in an environment with airborne paper powder and the like, failure in rocking of the rocking frame 4 or the like is hard to occur due to the accumulation of the paper powder and the like on the rolling surface 41*f*. This enables to enhance the durability against the paper powder and the like.

The reason why the roller 46 can remove the paper powder and the like from the rolling surface 41*f* will be described as follows.

Figure 5:
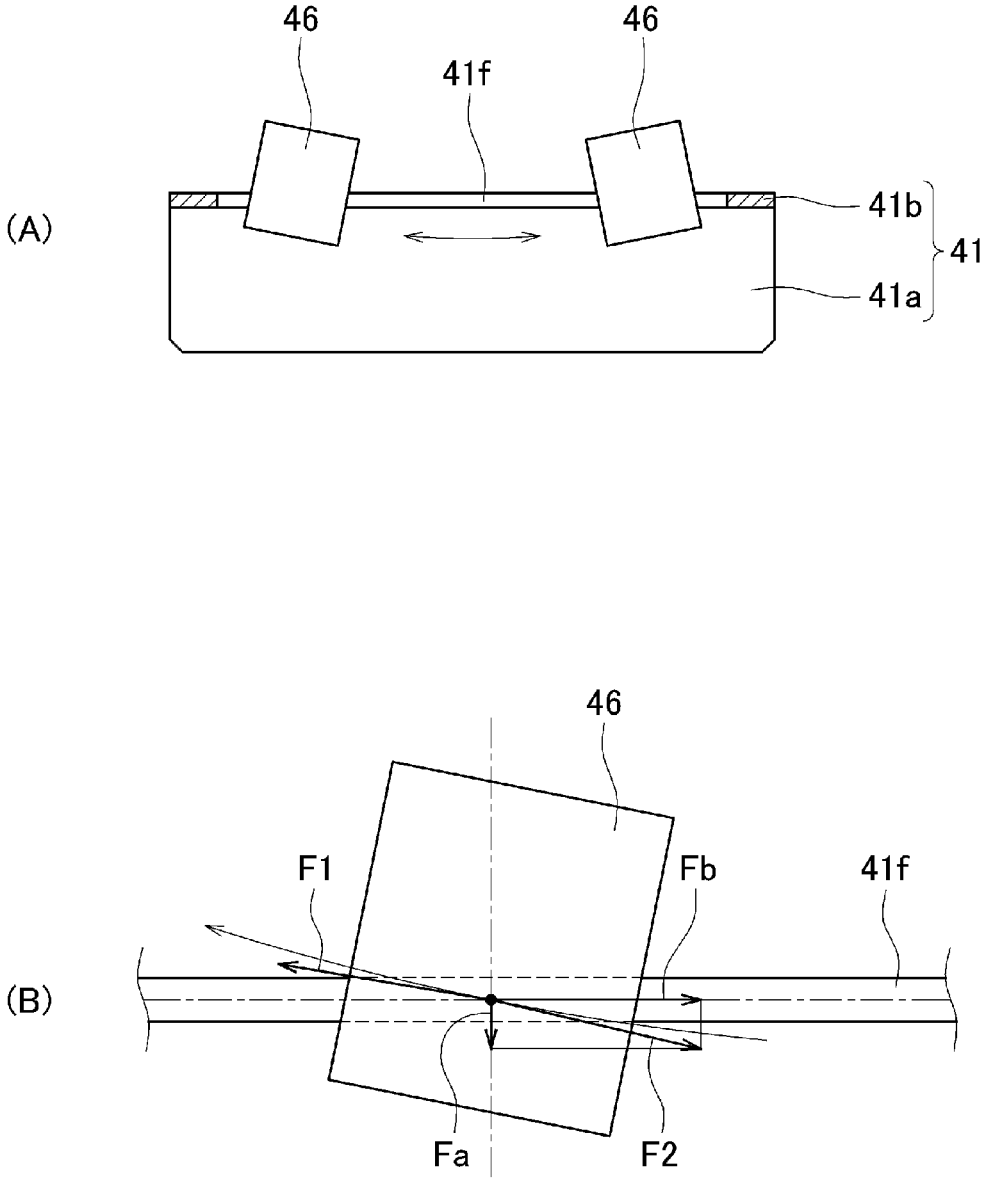
FIG. 5 shows (A) a diagram illustrating a relative positional relationship between rollers 46 and a rolling surface 41*f* and (B) a diagram illustrating a relationship between forces generated between the roller 46 and the rolling surface 41*f*.
Figure 6:
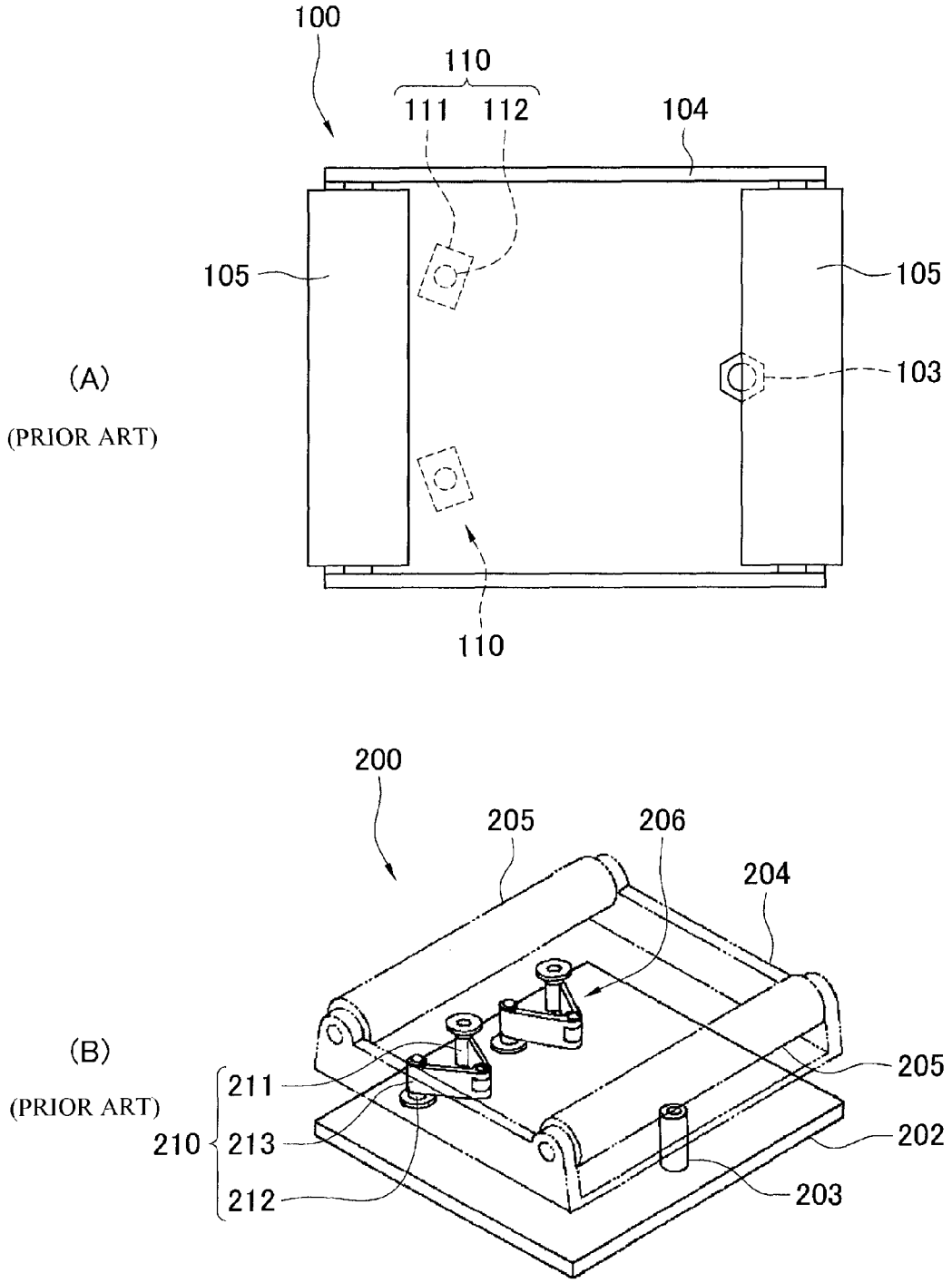
FIG. 6 shows schematic views of a conventional web guiding apparatus.

As illustrated in FIG. 5, when the roller 46 rolls, a friction force F2 balancing with a force F1 causing the roller 46 to move is generated between the rolling surface 41*f* and the roller 46. Since a moving direction of the roller 46 is inclined to the axial direction of the rolling surface 41*f*, a direction of the friction force F2 is inclined to the axial direction of the rolling surface 41*f*.

The friction force F2 has a component force Fa in a direction perpendicular to the axial direction of the rolling surface 41*f*, and therefore, the component force Fa scrapes the paper powder and the like out in the direction perpendicular to the rolling surface 41*f* even if the paper powder and the like is accumulated on the rolling surface 41*f*.

Rolling of the roller 46 therefore discharges the paper powder and the like appropriately from the rolling surface 41*f* even if the paper powder and the like is accumulated on the rolling surface 41*f*. As a result, failure in rocking of the rocking frame 4 or the like is hard to occur due to the accumulation of the paper powder and the like on the rolling surface 41*f*, enabling to enhance the durability against the paper powder and the like.

(Regarding Base Member 41)

Although the case of using a plate-like member as the base member 41 has been described, a material of the base member 41 is not particularly limited. For example, a block-like member (such as a member having a width wider than that of the roller 46) may be used as the base member 41. However, space for discharging the scraped paper powder and the like (for example, a groove formed along the rolling surface 41*f*) must be formed around the rolling surface 41*f* in order to obtain an effect of scraping the paper powder and the like out from the rolling surface 41*f*. It is therefore preferred that a plate-like member is used as the base member 41. This is because simply forming a through hole can form the housing hole 41*h* and the rolling surface 41*f*, as well as the space for discharging the paper powder and the like around the rolling surface 41*f*.

Additionally, as the width of the rolling surface 41*f* becomes smaller, the paper powder and the like becomes harder to be accumulated, and further, an effect of scraping the paper powder and the like out can be more remarkably exerted. When the plate-like member is used as the base member 41, a plate thickness thereof, that is, the width of the rolling surface 41*f* is preferably smaller as long as the plate-like member having the thickness thereof can endure a load applied from the roller 46.

Although the case of providing the roller 46 in the housing hole 41*h* has been described in the above example, the roller 46 may be placed on an upper surface of the base member 41 or the like to roll with the upper surface as a rolling surface.

However, the above configuration allows both surfaces sandwiching an axis of the housing hole 41*h* to function as a rolling surface.

The roller 46 can then roll with the inner surface of the housing hole 41*h* (the upper inner surface in FIG. 3) as the rolling surface 41*f* even if the apparatus is provided so that the rocking frame 4 is located below the base 2 (a state of being upside down compared with the state in FIG. 2). In other words, the rollers 46 can come into contact with the rolling surface 41*f* even if the apparatus is provided at any place, enabling to enhance a degree of freedom in a layout or the like of equipment to which the apparatus is provided.

When the roller 46 is provided in the housing hole 41*h*, a clearance D is required between the roller 46 and the inner surface of the housing hole 41*h* (see FIG. 3) in order to smoothly roll the roller 46 on the rolling surface 41*f*. If the clearance D is too small, the roller 46 may not roll smoothly at the time of the accumulation of the paper powder and the like. On the other hand, if the clearance D is too large, the roller 46 may not come in contact with the rolling surface 41*f* when the apparatus is provided so that the rocking frame 4 is located below the base 2. The clearance D suitable for smoothly rolling the roller 46 also changes depending on an environment where the apparatus is used (such as a state of airborne paper powder, a temperature and humidity).

The clearance D may therefore be adjusted to be in an optimum state where the roller 46 can come in contact with the rolling surface 41*f* even if the apparatus is provided in any direction, and further, the roller 46 can smoothly roll on the rolling surface 41*f* in an environment where the apparatus is used.

The case where the base member 41 is provided so that the normal direction of the surface of the vertical part 41*b* is perpendicular to the tangential direction of the arc with the rocking shaft 3 as the center has been described in the above example. However, the base member 41 may be provided so as to exert the above effect, namely an effect that the roller 46 scrapes the paper powder and the like out from the rolling surface 41*f* when rolling. That is, the base member 41 may be provided so that the roller 46 rotates around the central axis intersecting the axial direction of the rolling surface 41*f* to roll along the axial direction of the rolling surface 41*f* when the rocking frame 4 rocks.

Specifically, since the roller 46 rolls along the arc with the central axis of the rocking shaft 3 as the center, the axial direction of the rolling surface 41*f* may intersect an arc-like passage through which the roller 46 passes.

INDUSTRIAL APPLICABILITY

In a production line or a required processing line for a belt-shaped material (a web) made of paper, a nonwoven fabric, a film, a steel plate, or the like, the web guiding apparatus of the present invention is suitable as an apparatus for properly correcting meandering of a web during running.

REFERENCE SIGNS LIST

1 web guiding apparatus
2 base
2*s* reference surface
3 rocking shaft
4 rocking frame
5 roller
40 support portion
41 base member
41*h* housing hole
41*f* rolling surface
46 roller

The invention claimed is:

1. A web guiding apparatus for preventing meandering of a web conveyed successively, comprising:

a base;

a rocking frame rocking around an axis perpendicular to a reference surface of the base;

a web roller for the web provided on the rocking frame and having a rotation axis parallel to the reference surface of the base, the web being wound around the web roller; and a support portion provided between the rocking frame and the base, and supporting movement of the rocking frame with respect to the base, wherein the support portion comprises:

a base member provided on the base and having a rolling surface parallel to the reference surface of the base; and a roller provided on the rocking frame so as to roll on the rolling surface of the base member, the rolling surface of the base member is formed so that its axial direction is parallel to a tangential direction of an arc with a rocking shaft of the rocking frame as a center, a width of the roller is wider than a width of the rolling surface of the base member, and the roller is provided so as to move along the arc with the rocking shaft of the rocking frame as the center when the rocking frame rocks.

2. The web guiding apparatus according to claim 1, wherein the base member comprises:

a housing hole of a long hole extending along a direction parallel to the reference surface of the base, the roller being provided in the housing hole, a pair of the rolling surfaces is formed on a pair of inner surfaces, in the housing hole, extending along an axial direction thereof and opposed with each other.

* * * * *